United States Patent [19]

Bryand

[11] 4,050,131

[45] Sept. 27, 1977

[54] ROLL WITH INNER AND OUTER, SPACED AXIALLY EXTENDING TRIANGULAR MESH STRIPS

[75] Inventor: Edward T. Bryand, Saco, Maine

[73] Assignee: Honeycomb Systems, Inc., Biddeford, Maine

[21] Appl. No.: 747,607

[22] Filed: Dec. 6, 1976

[51] Int. Cl.[2] ..... D21F 3/10

[52] U.S. Cl. ..... 29/121.3; 162/372

[58] Field of Search ..... 29/121.3, 121.2; 162/372, 368

[56] References Cited

U.S. PATENT DOCUMENTS

| | | | |
|---|---|---|---|
| 3,100,928 | 8/1963 | Bryand | 29/121.2 |
| 3,829,360 | 8/1974 | Holz | 29/121.3 X |
| 3,906,616 | 9/1975 | Bryand | 29/121.3 |

*Primary Examiner*—Alfred R. Guest

*Attorney, Agent, or Firm*—Pearson & Pearson

[57] ABSTRACT

An open meshwork, hollow cylindrical roll which may be up to thirty feet in axial length and up to sixteen feet in outside diameter has alternate axially-extending, straight and undulated strips of thin material supported in radial grooves in a pair of opposite end rings. The straight strips are imperforate, planar and of substantial width, and the undulated strips are narrow and comprise an inner strip extending between the lower portions and an outer strip extending between the outer portions of each pair of adjacent straight strips. The undulations are V-shaped with at least half of each apex cut away for welding.

11 Claims, 10 Drawing Figures

20
21
22
2
2
7
7
25
26
27
28
30
32
33
34
35
37
38
39
45
46
47
48
49
55
56

20
21
22
25
26
27
28
29
30
32
34
35
36
37
38
39
41
42
43
44
45
46
51
52
53
54
7
7

20
21
22
4
4
8
8
25
26
27
28
30
32
33
34
35
37
45
46
47
48
49
51
52
55
56
57
58
59
61

20
21
22
8
8
25
26
27
28
29
30
34
35
36
37
38
39
41
42
43
44
45
46
48
49
51
52
53
54
59
61

ROLL WITH INNER AND OUTER, SPACED AXIALLY EXTENDING TRIANGULAR MESH STRIPS

BACKGROUND OF THE INVENTION

Foraminous rolls of the type of this invention are well known, and are the subject matter of numerous patents of Edward T. Bryand such as U.S. Pat. Nos. 3,259,961; 3,139,375; 3,564,686; 3,590,453 and 3,630,838. Such rolls are known in the art as "Honeycomb Rolls" a Trademark of Metal Tech, Inc. of Biddeford, Maine and have usually consisted of alternate straight and undulated axially extending strips in which the undulations have a pair of diagonal webs connected by a straight web, thereby creating a full hexagonal, or half hexagonal open mesh grid structure as the foraminous shell of the roll, or drum.

A foraminous roll of a different grid structure has been proposed in U.S. Pat. No. 3,773,614 to Pennington of Nov. 20, 1973, wherein alternate flat planar strips and undulated strips are convoluted helically or circumferentially of the elongated roll, rather than extending axially thereof. In the roll of this patent the undulations are substantially half hexagonal with two diagonal webs connected by a straight web and a rigid, cylindrical perforated shell is required to support the grid structure.

In an earlier U.S. Pat. No. 3,105,043 to Rich of Sept. 24, 1963, a grid structure is proposed which is also of the helically wound, circumferentially-extending, alternate flat planar and half hexagonal waved strip type. In this patent the hexagonal waved strips are divided into an inner strip and an outer strip, there being no waved strip in the space therebetween. However the space is occupied by a plurality of integral flaps, bent out of the planar strips to leave a corresponding opening in the planar strips.

SUMMARY OF THIS INVENTION

No rigid perforated shell is required to support the grid structure of this invention, despite its axial length of up to thirty feet and its diameter of up to twenty feet. This is because the grid structure includes the spaced apart axially extending, relatively wide, thin straight strips, spanning the space between the end discs and having their opposite ends firmly seated in radial grooves therein. The straight strips are planar, imperforate and may be from 1 to 6 inches in width, depending on roll length.

A pair of narrow, undulated strips of thin metal or plastic are provided, one such strip extending axially along the inner portions of each adjacent pair of straight strips, and the other such strip extending axially along the outer portions of each adjacent pair of straight strips. There are no obstructions in the space between the pair of strips which extends along the intermediate portions of each adjacent pair of straight strips.

The narrow undulated strips of the invention may be from ¼ inch to 2 inches in width depending on the length of the roll and the corresponding width of the straight strips.

Each narrow undulated strip is provided with V-shaped undulations terminating in sharp pointed apices and each apex is cut away for at least half its width to enable easy bending as well as to enable ready access for welding the apices to the straight strips.

The outer undulated strip may be recessed inside the outer edges of the adjacent straight strips to minimize strip contact with a web supported on the roll and to present only a single thickness of strip to such a web for producing nearly 95% open area on the roll surface. Preferably however the outer edges of the outer undulated strip and the outer edges of the straight strips are flush with each other, but the junctures of the apices of the undulated strips are blended, or merged with the outer edges of the straight strip to still present only one thickness of strip to such a web.

DESCRIPTION OF A PREFERRED EMBODIMENT

Figure 10:
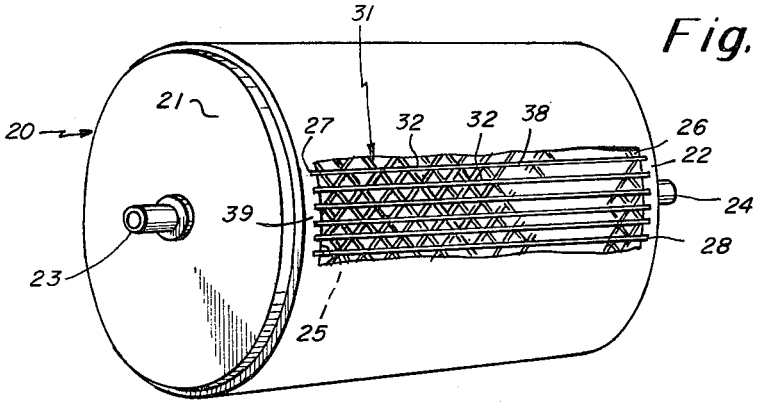
FIG. 10 is a perspective view of a foraminous roll of the invention.

In the drawing an open meshwork hollow cylindrical roll 20 of the invention is shown in FIG. 10, the roll 20 having a pair of opposite end rings, or heads 21 and 22 each supported on hollow shaft means 23 and 24 in a well known manner. The inner peripheral faces 25 and 26 of the end rings 23 and 24, each are provided with a plurality of radially extending spaced apart grooves such as at 27 and 28.

The hollow cylindrical shell 31 is formed of a plurality of straight, wide, thin, planar strips such as 32 and 33 each extending axially of the elongated roll 20, for the full length thereof from one end ring 21 to the other end ring 22. Each opposite end 34 or 35 of the full axial length strips 32 or 33 is seated in one of the opposite radial grooves 27 or 28 and welded, brazed or otherwise affixed therein. The inner edges 36 of each strip rest on an annular ring 37 for assembly purposes, to position the outer edges 38 of the radially extending strips flush with the circumferential faces 39 of the end rings.

The full axial length strips 32 and 33 are imperforate and have inner portions 41, intermediate portions 42, midway of the width thereof and outer portions 43, the outer portions terminating in the outer edges 38.

Figure 1:
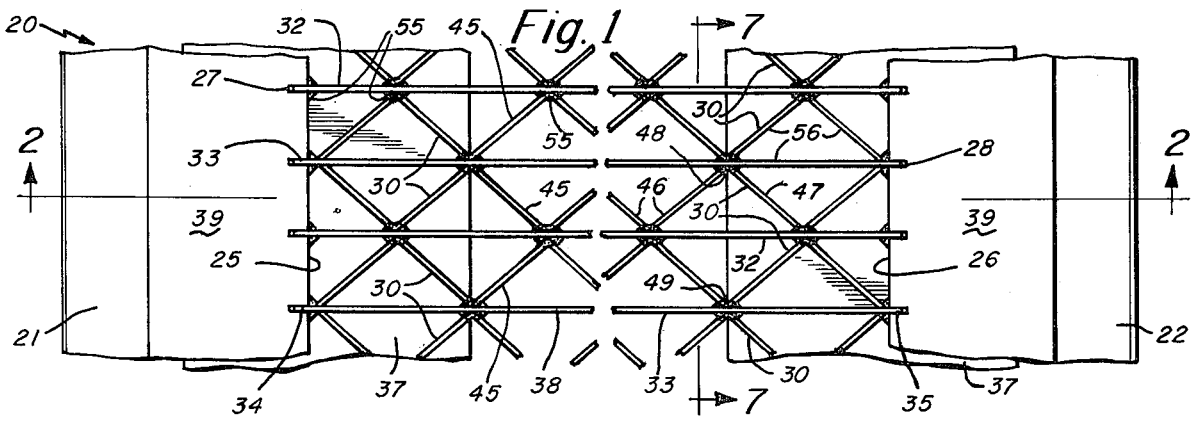
FIG. 1 is a fragmentary top plan view of a section of a roll, having a triangular mesh grid structure of the invention.
Figure 2:
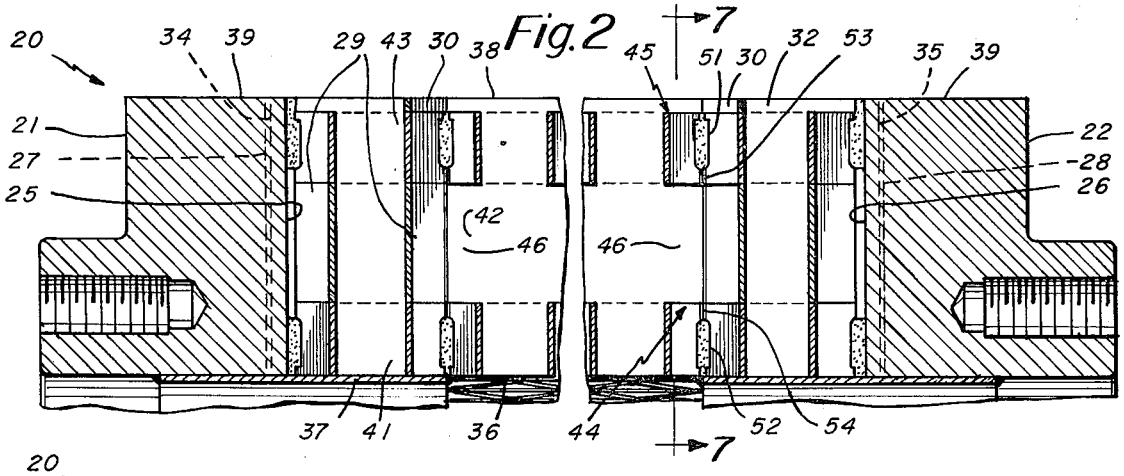
FIG. 2 is a fragmentary front elevation of a section of the roll shown in FIG. 1, in section on line 2—2 of FIG. 1.

As shown in FIGS. 1 and 2 a plurality of pairs of undulated, narrow, full axial length, strips are provided. Each pair comprises an inner, undulated strip 44, extending axially from one end ring to the other, between the inner portions 41 of each pair of adjacent straight strips such as 32 and 33 and an outer undulated strip 45 extending axially from one end ring to the other between the outer portions 43 of each pair of adjacent straight strips such as 32 and 33. The space 46 between the intermediate portions 42 of each pair of adjacent straight strips is free of obstructions, and free of any undulated strips, flaps, tabs or the like.

Each undulated strip 44 or 45 is formed into a series of identical V-shaped undulations such as at 46 and 47, the V-shaped undulations terminating in a sharp apex portion 48 or 49, the sharp apex portions being cut away as at 51 and 52 for at least half the width of the strips to leave a connecting web 53 or 54.

Each apex, or node, of each narrow undulated strip 44 or 45 is heliarc welded as at 55, at the slots or cut aways, 51 or 52 all along the pair of adjacent straight strips 32 and 33 to interconnect the inner and outer undulated strips thereto and thereby form open mesh cells of triangular configuration as at 56, the cells having no flat wall at the apices 48 or 49.

Figure 7:
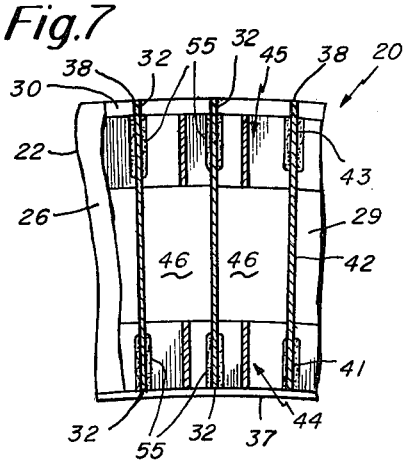
FIGS. 7, 8 and 9 are fragmentary end elevations in section on line 7—7 of FIG. 2, line 8—8 of FIG. 4 and line 9—9 of FIG. 6, respectively.

As shown in FIG. 1, 2 and 7 each straight strip 32 or 33 is seated in a radial groove in the end rings and the outer strips 45 are affixed at a spaced distance inwardly from the outer edges 38 of the straight strips so that a web supported on the roll surface is in contact only with one thickness of strip to increase open mesh area.

Figure 3:
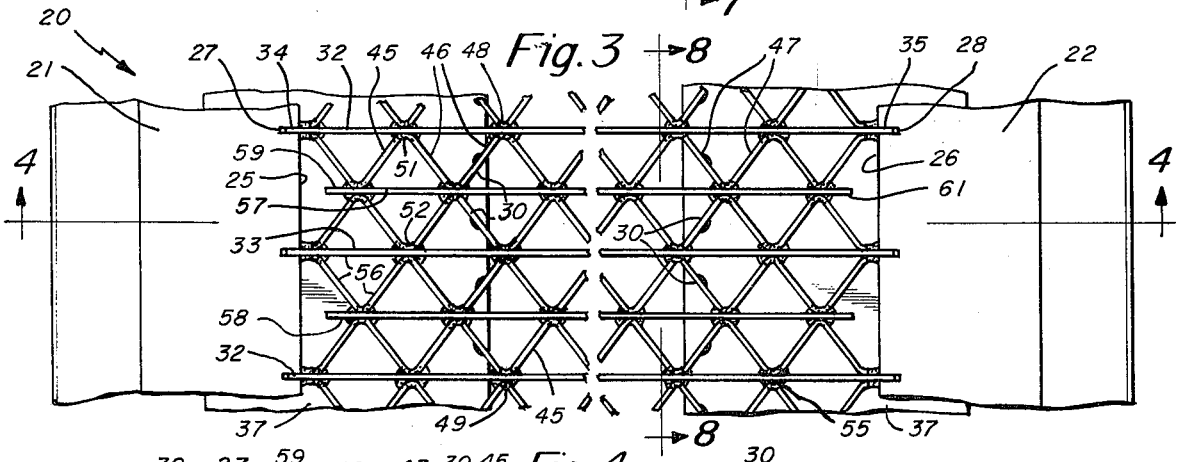
FIG. 3 is a view similar to FIG. 1 of another embodiment of the invention.
Figure 4:
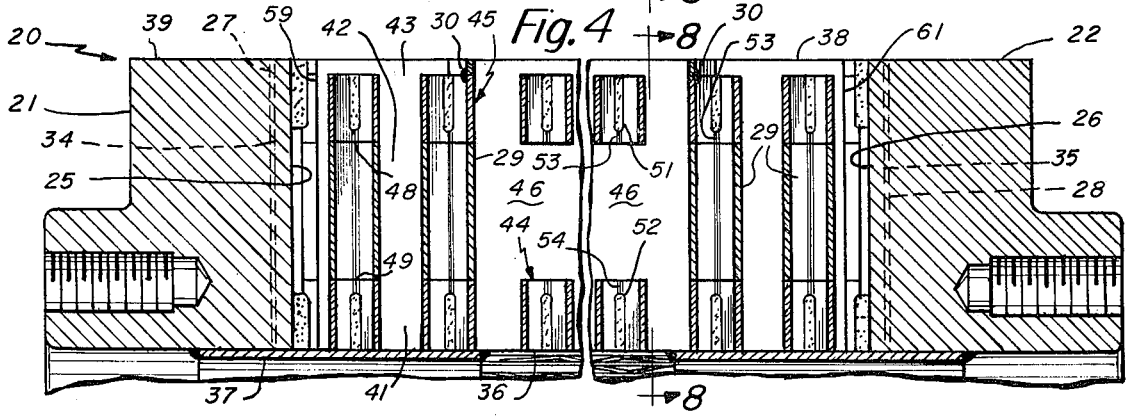
FIG. 4 is a view similar to FIG. 2 of the embodiment of FIG. 3 in section on line 4—4 of FIG. 3.
Figure 8:
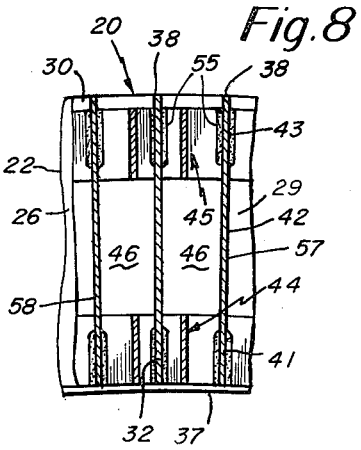

In FIGS. 3, 4 and 8, alternate straight strips 32 and 33 are seated in the radial grooves 27 and 28 but the straight strips 57 and 58 are not so seated and are not full width. Instead the alternate strips 57 and 58 terminate at 59 and 61 at a spaced distance inside the end rings and are equal in width to the width of the narrow undulated strips to which they are welded.

Figure 5:
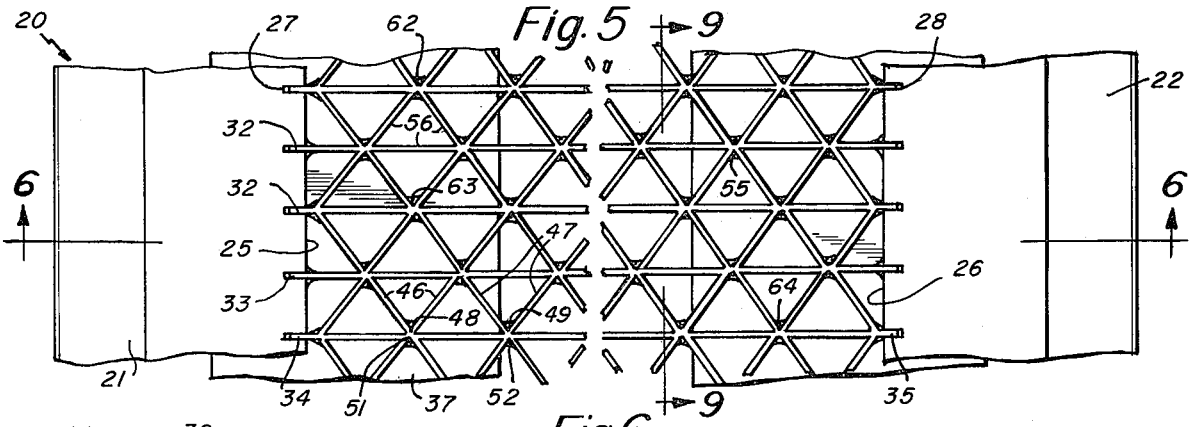
FIG. 5 is a view similar to FIG. 1 and FIG. 3 of still another embodiment of the invention.
Figure 6:
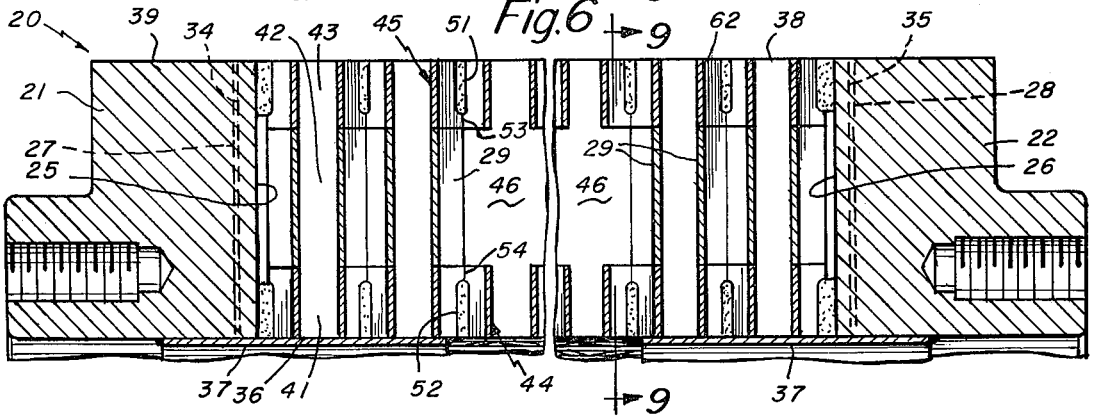
FIG. 6 is a view similar to FIG. 2 and FIG. 4 of the embodiment of FIG. 5, in section on line 6—6 of FIG. 5.
Figure 9:
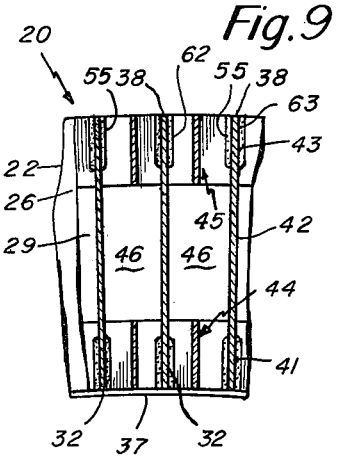

In FIGS. 5, 6 and 9 another embodiment of the invention is shown in which the outer edges 62 of the outer undulated strips 45 are flush with the outer edges 38 of the straight strips but the junctions of the apices of each two undulated strips with a straight strip as at 63 and 64 are merged to present only a single thickness of one said strip to a web supported on the roll 20 in the area of the said junction.

Preferably the angle of the diagonal webs of the undulated strips to the straight strips of the triangular mesh of the invention is about 52° rather than 60°.

As shown in FIG. 1 a filler 29 of triangular mesh configuration is provided at each end of the shell 31, as is a full height dam 30, both for deckle purposes.

I claim:

1. A roll comprising a pair of shaft-supported, end rings each having an inner peripheral face with a plurality of radial grooves spaced therearound and an elongated hollow cylindrical grid-like shell said shell having:

a plurality of straight, wide, thin, planar, strips, each extending axially of said roll, each opposite end of alternate straight strips being seated in one of the radial grooves in said end rings and said strips having inner, intermediate and outer portions, and a plurality of pairs of undulated, narrow, thin strips, one strip of each pair extending axially of said roll between the opposite inner portions of each adjacent pair of said straight strips, the other strip of each pair extending axially of said roll between the opposite outer portions of each said adjacent pair of said straight strips, and the intermediate portions of said straight strips being free of any undulated strips, said undulated strips having V-shaped undulations with sharp apex portions, each said apex portion being cut away for at least half its width and said undulated strips being interconnected with said straight strips at said sharp, cut away, apex portions to form triangular shaped open mesh therewith.

2. A roll as specified in claim 1 wherein:

each said undulated strip extending between the outer portions of adjacent straight strips is interconnected thereto at a spaced distance inside the outer edges of said straight strips to minimize contact area with any web supported on said roll.

3. A roll as specified in claim 1 wherein:

all of said straight strips are seated in said grooves and extend from one said ring to the other said ring.

4. A roll as specified in claim 1 wherein:

said alternate straight strips extend from the grooves in one end ring to the grooves in the opposite end ring and are full width and the straight strips between said alternate strips terminate at a spaced distance from said end rings and are equal in width to the said undulated strips.

5. A roll as specified in claim 1 wherein the cut away portions of the sharp apices of each V-shaped undulations of each undulated strip extending between the outer portions of adjacent straight strips is on the outside edge of said strips and said outside edge is flush with the corresponding outside edge of said straight strips, the juncture of the outer edges of the straight strips with the apices of the undulated strips on each opposite side thereof being blended, or merged into a single thickness of said strips.

6. A foraminous roll of the type having a pair of end rings with a hollow cylindrical, open mesh, grid extending therearound, the grid being formed by alternate, axially extending, straight and undulated strips characterized by the straight strips being of predetermined width, the undulated strips being of predetermined lesser width and arranged in pairs, one undulated strip of each pair extending between the inner portions of each pair of straight strips, and the other undulated strip of each pair extending between the outer portions of each said pair of straight strips and the intermediate portions of each pair of straight strips being free of obstructions to flow and free of any undulated strips, the undulations in said strips being V-shaped with sharp apices, the sharp apices thereof being welded to the adjacent straight strips.

7. A formaninous roll as specified in claim 6 wherein:

each said undulated strip includes a cut away, or slot, at each sharp apex thereof, said slot extending a substantial portion of the width of the strip.

8. A foraminous roll as specified in claim 6 wherein:

said undulated strips of lesser width extend axially of said roll in the central portion thereof but said roll includes undulated strips, equal in width to the width of said straight strips proximate each opposite end thereof for deckle purposes.

9. A foraminous roll as specified in claim 6 wherein:

each alternate straight strip is formed of a pair of narrow strips comprising an inner strip interconnected between a pair of adjacent, inner undulated strips and an outer strip interconnected between a pair of adjacent outer undulated strips.

10. A foraminous roll as specified in claim 9 wherein:

each said inner strip and outer strip of said alternate straight strips is of reduced axial length and terminates at each opposite end thereof at a spaced distance from the adjacent end ring.

11. A foraminous roll as specified in claim 6 wherein:

each said other outer undulated strip of each said pair of lesser width strips is interconnected to said straight wide strips at a spaced distance inward from the outer edges of said straight strip to minimize contact with a web supported on said roll.

* * * * *